US005190230A

United States Patent [19]

Cowan

[11] Patent Number: 5,190,230

[45] Date of Patent: Mar. 2, 1993

[54] NON-CATENARY TOW WINDER

[75] Inventor: Larry C. Cowan, Burlington, N.C.

[73] Assignee: John Brown Inc., West Warwick, R.I.

[21] Appl. No.: 764,223

[22] Filed: Sep. 23, 1991

[51] Int. Cl.[5] ..... B65H 54/00

[52] U.S. Cl. ..... 242/42; 242/40; 242/45; 226/108

[58] Field of Search ..... 242/42, 45, 38, 39, 242/40, 49, 47, 47.01, 47.08, 47.09, 147 R, 35.5 R; 226/108, 111, 195

[56] References Cited

U.S. PATENT DOCUMENTS 1,595,818 8/1926 Bliss ..... 242/45 X 2,969,197 1/1961 Weber et al. ..... 242/39 X 3,777,470 12/1973 Suzuki et al. ..... 242/242 X

*Primary Examiner*—Stanley N. Gilreath

*Attorney, Agent, or Firm*—Breiner & Breiner

[57] ABSTRACT

A winder and method for winding a plurality of yarn strands on a package with each yarn strand on the package having the exact same length to provide an exceptionally low catenary yarn package is described. A plurality of yarn strands are fed individually to a plurality of godets, the first godet being driven at a slightly slower speed than the remaining godets to stabilize each yarn strand by underfeeding and tensioning each strand, and the remaining godets measuring and metering equally each strand, providing packages at predetermined tensions and package pressure for trouble-free unrolling and unwinding.

4 Claims, 2 Drawing Sheets

NON-CATENARY TOW WINDER

FIELD OF INVENTION

This invention relates to tow winding. More specifically, the invention relates to a non-catenary tow winder for producing exceptionally low catenary yarn tow packages.

BACKGROUND OF INVENTION

Conventional tow winding produces packages where individual strands within the tow are of unequal length. As a result, in downstream or subsequent operations some ends sag, forming a catenary which is detrimental in many end use applications. Moreover, when winding high tenacity flat tow yarns, i.e., yarns which have no elongation or stretch, if each yarn strand is not of the exact same length, only the shortest strand will be effective in building the tow yarn package. Accordingly, individual tow yarns will wind onto the tow package with different characteristics such as length and tension, creating a package having strands with non-uniform tension and length, again a characteristic which is detrimental in many end use applications.

Accordingly, there has been a need for an apparatus and method permitting the simultaneous winding of tow yarn where each tow strand is of the exact same length and is on the package with the exact same characteristics.

SUMMARY OF INVENTION

The present invention provides a winder and method for winding a plurality of yarn strands with each yarn strand on the package having the exact same length to provide an exceptionally low catenary yarn tow package. According to the invention, it has been found that low or zero catenary tow packages mandate that each yarn strand is controlled and accurately measured simultaneously with all other strands in the tow package. With the presently disclosed winder and method of winding, a plurality of yarn strands will feed individually over a guide wheel from individual yarn supplies to a plurality of godets. The first godet is driven at a slightly slower speed than the remaining godets to stabilize each yarn strand by underfeeding and tensioning each strand, insuring consistent yarn bundle integrity and straightness. The remaining godets measure and meter equally each strand, providing packages at predetermined tensions and package pressure for trouble-free unrolling and unwinding.

DRAWINGS AND PRESENTLY PREFERRED EMBODIMENT

In the drawings, wherein like numbers define like parts,

Figure 2:
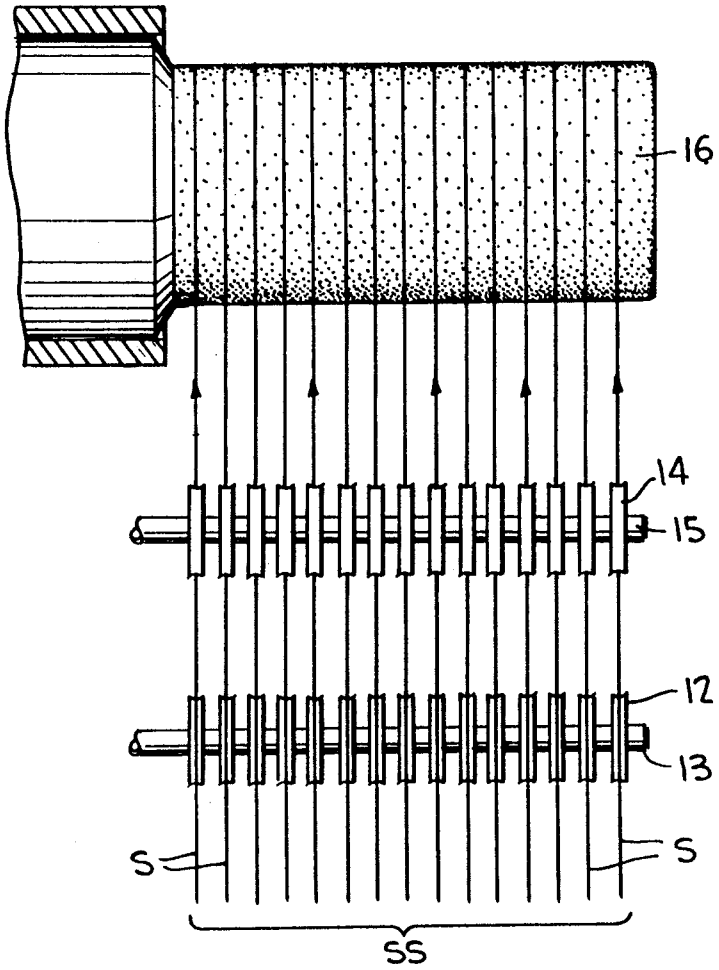
FIG. 2 is a plan view of a plurality of yarn strands passing over guide wheels onto a first godet.
Figure 1:
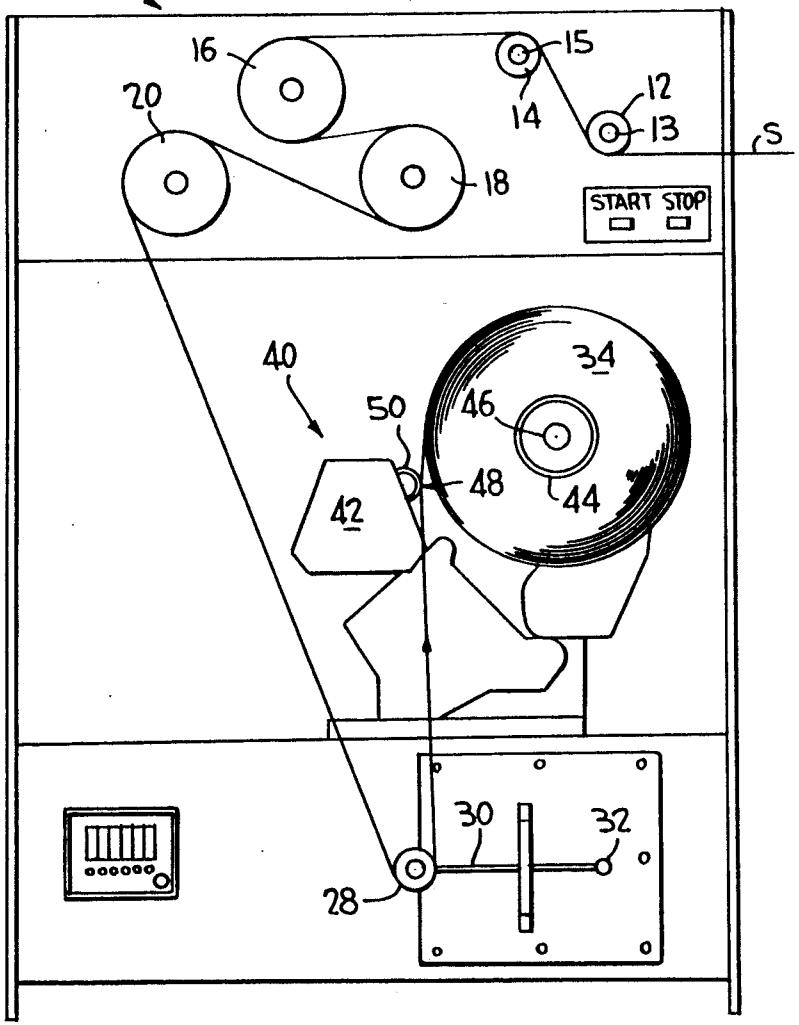
FIG. 1 is a front schematic view of a winder according to the present invention.
Figure 4:
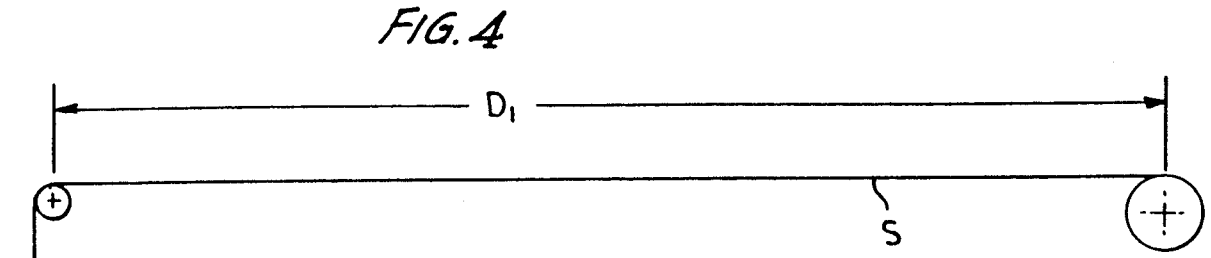
FIG. 4 is a view of a plurality of yarn strands having zero catenary.
Figure 5:
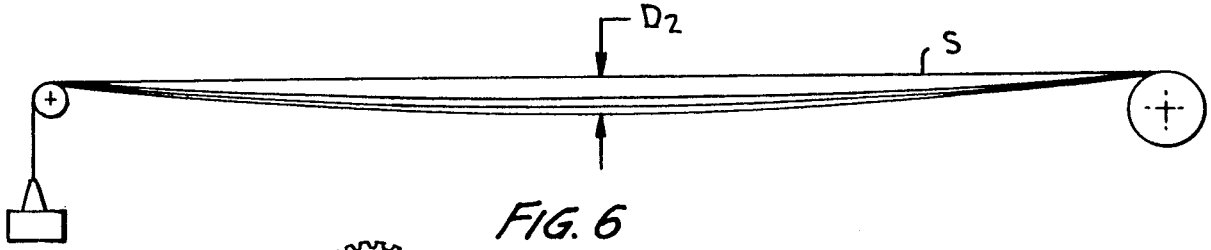
FIG. 5 illustrates a yarn tow wherein the plurality of strands are of different lengths, forming a catenary.
Figure 6:
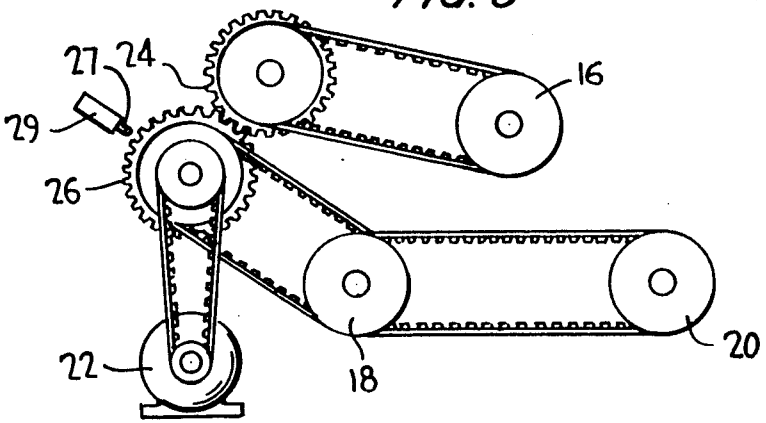
FIG. 6 is a view showing a regenerative motor simultaneously driving the plurality of godets.
Figure 3:
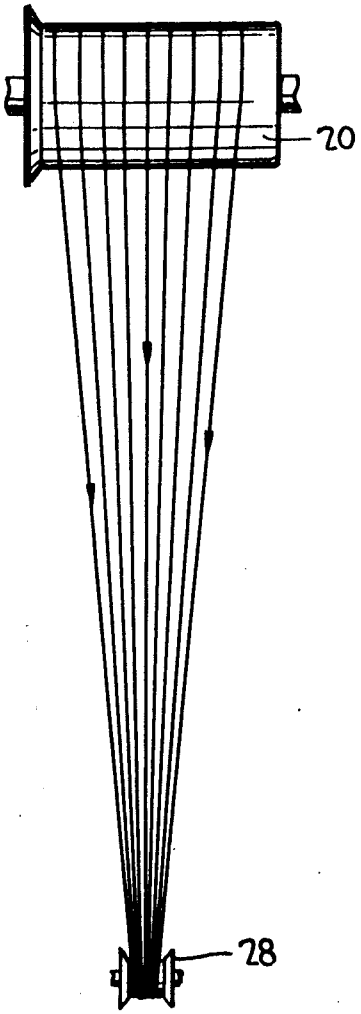
FIG. 3 is a front view of a plurality of strands coming off of a godet down to a compensator wheel positioned on a compensator tensioning arm.

Referring first to FIGS. 1 and 2 plurality of yarn strands S from a yarn supply SS are fed to an equal number of guide wheels 12 and 14 ganged on common shafts 13 and 15, respectively, whereby each set of wheels 12 and 14 guides a single yarn strand. The yarn strands are then fed to godet 16 and from godet 16 to godets 18 and 20. Each of godets 16, 18 and 20 is driven by a common regenerative one-half horse power DC motor 22 by a plurality of gears and belts as shown in FIG. 6. However, godet 16 is driven, because of the different number of gear teeth in gears 24 and 26, at a lower speed than godets 18 and 20, thus underfeeding the yarn strands. Thus each yarn strand between godets 16 and 18 is tensioned to remove slack and evenly pull each yarn length onto godets 18 and 20. Godet 20 has a sensor 27 associated therewith which sends pulses to an electronic yardage counter 29, shown in FIG. 6, for measuring the yarn strands being fed to the take-up package over compensator wheel 28 at the end of a compensator arm 30 pivoting at pivot point 32. In this way, the yarn being fed onto package 34 is fed at exactly equal lengths with each strand having the same tension. Accordingly, the final package will have a predetermined, uniform tension and package pressure.

The winding unit generally designated 40 in FIG. 1 is a conventional winding unit such as a Leesona Model 966 tension controlled take-up. Such winders will include a guide/traverse means 42 for winding a package 34 onto a tube 44 carried on a spindle 46. Spindle 46 is driven by an electric motor, not shown, the speed of which is controlled by the tension on the compensator arm 30, as is conventional. The guide/traverse means includes a strand guide 48 and a roller ball 50. These units, which are conventional, are described in commonly assigned Brouwer et al application Ser. No. 07/060,482, filed Jun. 11, 1987, entitled "Take-Up Mechanism," which application is incorporated herein by reference.

The electronic yardage counter 29 is a commercially available unit; for example, a model LNXN2, marketed by Red Lion Controls, 20 Willow Springs Circle, York, Pa. 17402. This unit counts impulses and translates these impulses to length measurements. Thus, in the present unit, impulses are received for each gear tooth of gear 26 by sensor 27 and sent to the electronic yardage counter 29. These impulses, based on the gear teeth, are then translated into length measurements.

The godets 16, 18 and 20 as shown in FIG. 1 are cylindrical and mounted parallel on upper structure assembly 25. Each godet has an outer surface having a high friction coefficient, which enhances the control of the yarn strands passing over the godets. The speed of the godets is controlled by a speed drive control circuit encompassing regenerative DC motor 22. Abnormalities in the system are prevented or controlled by tying regenerative motor 22 together with the motor driving spindle 46. In the preferred embodiment as herein described, the speed of godet 16 is 98.33 percent of the speed of godets 18 and 20. This is accomplished by using a gear 26 with sixty teeth and a gear 24 with fifty-nine teeth. Using the winder of the present invention, yarn speeds of up to five hundred meters per minute are achievable when winding up to 20 to 30 strands to provide yarn packages having uniform individual strand lengths and controlled tension and package pressure.

As will be apparent to one skilled in the art, various modifications can be made within the scope of the aforesaid description. Such modifications being within the ability of one skilled in the art form a part of the present invention and are embraced by the appended claims.

It is claimed:

1. A tow winder for winding a plurality of yarn strands simultaneously onto a package comprising in combination a plurality of guide wheels equal in number to the number of yarn strands to be wound for receiving and guiding said plurality of strands; at least first, second and third godets for receiving the plurality of strands from said guide wheels; a regenerative DC motor for driving said godets; drive means constructed and arranged with said motor for driving said first godet at a first speed and said second and third godet at a greater speed whereby said plurality of strands will be stabilized and tensioned and fed to said second and third godets at a constant speed and at uniform tension; means constructed and arranged with one of said second and third godets for measuring and metering equally the length of each strand; and take-up means for uniformly taking up said plurality of strands on a common package.

2. The tow winder of claim 1 wherein said guide wheels are one a common shaft.

3. The tow winder of claim 2 wherein said first godet is traveling at about 98% of the speed of the second and third godets.

4. A method of winding a plurality of yarn strands simultaneously onto a package comprising the steps of (1) feeding a plurality of yarn strands to a guide wheel for each strand; (2) receiving said plurality of strands from said guide wheels onto a first godet traveling at a predetermined speed; (3) receiving said plurality of strands from said first godet onto second and third godets traveling at a speed greater than the speed of said first godet, thereby stabilizing and tensioning uniformly said plurality of yarn strands; (4) measuring each of said plurality of yarn strands at said second or third godet so that each yarn strand is of the exact same length; and (5) taking up said plurality of yarn strands on a common package.

* * * * *